United States Patent [19]

Parker et al.

[11] 4,153,181

[45] May 8, 1979

[54] LIQUID DISPENSER

[75] Inventors: Wallace J. Parker; Gordon N. Nosser, both of Highland, Calif.

[73] Assignee: Parker-Nosser Company, Inc., Highland, Calif.

[21] Appl. No.: 820,593

[22] Filed: Aug. 1, 1977

Related U.S. Application Data

[63] Continuation-in-part of Ser. No. 709,648, Jul. 29, 1976, abandoned.

[51] Int. Cl.[2] ..... B67D 5/54

[52] U.S. Cl. ..... 222/61; 200/83 V; 222/400.8

[58] Field of Search ..... 222/61, 401, 400.8, 222/400.7, 129.1, 189, 562; 137/540, 542; 200/83 R, 83 U, 81.4, 81.5; 417/413

[56] References Cited

U.S. PATENT DOCUMENTS

| | | | |
|---|---|---|---|
| 2,431,596 | 11/1947 | Wickstrum | 222/400.8 |
| 3,067,302 | 12/1962 | Nielsen | 200/81.5 |
| 3,179,292 | 4/1965 | Terry | 222/400.8 X |
| 3,333,741 | 8/1967 | Radcliffe | 222/189 |
| 3,496,878 | 2/1970 | Hargest et al. | 417/413 X |
| 4,030,634 | 6/1977 | Osborn | 222/400.8 X |
| 4,070,133 | 1/1978 | McCormick | 222/400.8 X |

*Primary Examiner*—John P. Shannon

*Attorney, Agent, or Firm*—John H. Crowe

[57] ABSTRACT

A unit for dispensing water from a bottle. The parts of the unit include an air pump for pressurizing the bottle, a microswitch having a control button connected in circuit with the pump, a small pressure chamber with a distensible diaphragm for a top, a branched air line connecting the pump with the bottle and the pressure chamber, and a cabinet with rollers that can be rolled to a position of use around the upright bottle. Additionally, the unit includes a water line positioned to extend upwardly away from the bottle. A rubber cap encloses the bottle opening and the water line and a branch of the air line are in communication with the interior of the bottle by means of metal tubes passing through the cap. Fastened to the lower end of the metal tube for the water line is a section of flexible tubing long enough to reach to the bottom of the bottle. The microswitch is normally closed and the pressure chamber is positioned with its diaphragm close to the control button of the switch. When the air pressure in the bottle exceeds a certain limit, the diaphragm bulges outwardly into contact with the button and opens the microswitch. When water is drawn from the bottle through the water line, the air pessure drops, and the diaphragm shrinks away from the control button. This causes the microswitch to close and start the air pump operating to again build up air pressure in the bottle.

10 Claims, 13 Drawing Figures

28
56
46
10
58
82a
82
16
20
22
54
54

28
55
45
56
46
10
14
19
15
33
5
32
5
84
30
58
36
38
59
13
17
76
78
57
4
4
12
18
22
39
50
52
54
54
14

28
46
59
33
36
38
57
12
20
39
14
54

80
18
40
50
52
12
78
57
22
76
39
50
42
20
17
17
30
24
26
34
31
35
14
33
32
37
38
24
26
17
17

74
34
32
38

FIG. 7.
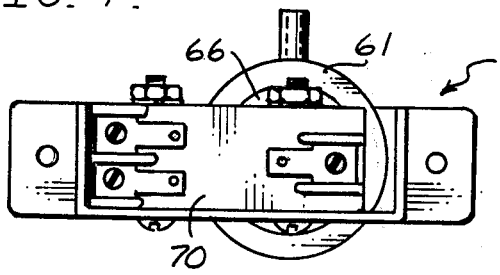
FIG. 8.
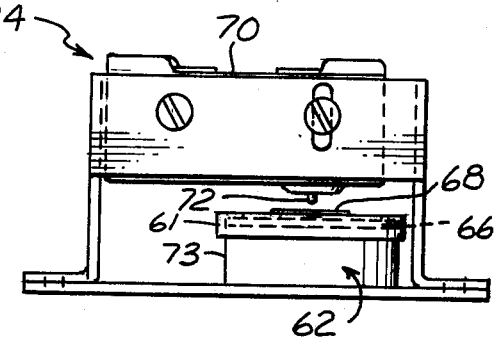
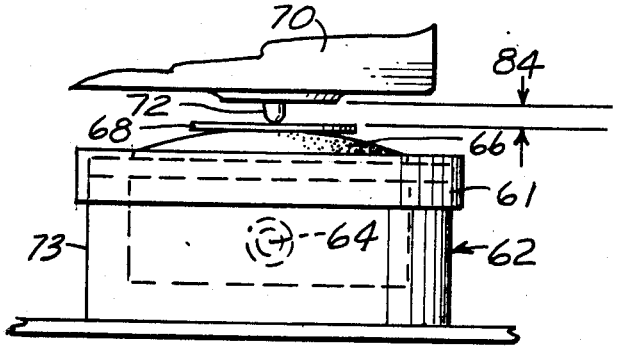
FIG. 10.
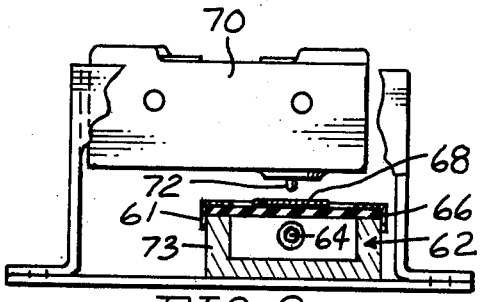
FIG. 9.
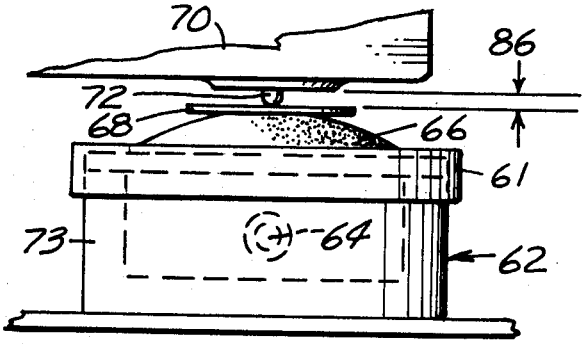
FIG. 11.
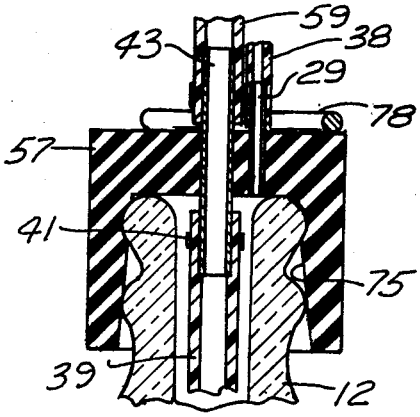
FIG. 13.
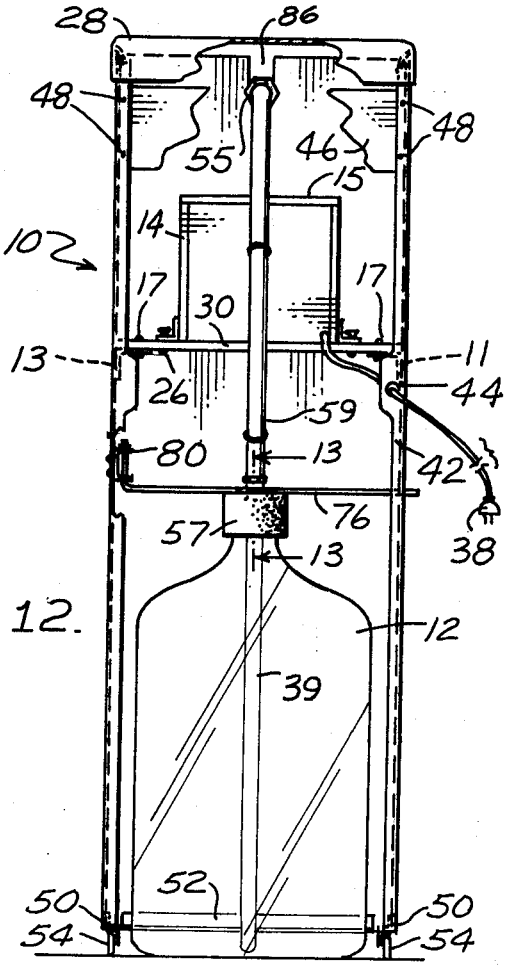
FIG. 12.

LIQUID DISPENSER

CROSS-REFERENCE TO RELATED APPLICATION

This application is a continuation-in-part of our copending U.S. application Ser. No. 709,648, filed July 29, 1976, abandoned.

BACKGROUND OF THE INVENTION

This invention relates generally to liquid dispensing means, and more particularly to such means for dispensing water from five-gallon water bottles.

The practice of selling drinking water in five-gallon bottles is not new, but in more recent years the volume of water thus sold, and the number of companies engaging in the sale of the water, have increased manyfold. From the beginning, the means for dispensing water from such five-gallon bottles has consisted essentially of a stand with a seat to support the shoulder of the bottle in upside-down position, and a gravity-flow faucet arrangement through which the water trickles at a relatively slow rate when the faucet is opened. This rather primitive dispensing apparatus has certain disadvantages, perhaps the chief of which is the necessity of lifting the heavy water bottle to the proper height for use and inverting it into the seat on the stand. A full five-gallon bottle of water weighs about 52 lbs., and this is a heavy weight for anyone to lift. Lifting and maneuvering the heavy bottle of water into its position could cause hernia, or other injury, in even a strong healthy man. For many people, such as most women, disabled persons, older individuals, children, and the like, the task is impossible. Also, there is an inherent risk that a bottle being lifted into position on a conventional dispensing stand will be dropped and break. The breakage of such a bottle causes a minor flood, and creates a mess of rather major proportions that must be cleaned up, as well as setting the stage for personal injury from broken glass and, in some cases, damaging property. Finally, as indicated above, the drawing of water from a water bottle on a conventional dispenser of the above-described type is a fairly slow procedure, and therefore one which is somewhat annoying to many individuals.

U.S. Pat. No. 3,179,292 to Terry discloses a water cooler having a platform adapted to support a pair of five-gallon water bottles and a three-sided cabinet into which the loaded platform can be rolled for use. The water cooler includes a refrigeration unit and an air pump driven by an electric motor to pressurize one of the bottles and thereby force water into the refrigeration unit for cooling. The air pump is of the piston type, and it is common knowledge among those familiar therewith that oil invariably gets past the piston of such a pump to contaminate the air being compressed. The disadvantages of this in a system in which the compressed air contacts drinking water are obvious. Furthermore, the air delivery system in the Terry water cooler has no built-in filtering means to strain particulate matter out of the air passing therethrough. It is well known that indoor air is laden with all types of particulate matter, including dust, soot and the like, and this "dirty" air is pumped directly into a water bottle by the Terry apparatus. Such particulate matter therefore contaminates Terry's drinking water, and, besides being obnoxious by its presence, it carries airborne bacteria into the water to deleteriously affect its potability.

From the foregoing, it will be evident that utilization of the Terry air pressurizing means on bottled water would result in contamination of the water by oil, particulate matter and bacteria and would thus be an unsatisfactory expedient to those bottled water subscribers (no doubt the majority) who use bottled water for its sparkling purity and freedom from unpleasant tasting components of the type found in tap water from the average municipal, or other, source.

SUMMARY OF THE INVENTION

We have now, by this invention, provided a relatively inexpensive liquid dispenser particularly suitable for use in dispensing drinking water from an upright five-gallon water bottle on the floor. When the dispenser is so employed, water is forced out of the bottle by pressurized air, but the air, unlike that of the Terry water cooler discussed above, is free from particulate and bacterial contamination, and free of oil or other foreign matter to pollute the water or give it an unpleasant taste. This air purity is achieved through the use of a field coil actuated pneumatic diaphragm pump with built-in filter means for removing particulate matter from the air being pumped. The pump is in circuit with a microswitch and a control button for turning the pump off and on as necessary to maintain a proper pressure level in the bottle. This pressure level is relatively low, normally within the range from 3 to 5 psig, to avoid any risk of bottle breakage where the bottle is made of glass (the dispenser being equally suitable for use on glass or plastic bottles).

Our novel water dispenser includes, as a critical part, a highly sensitive pressure chamber having a top formed as a distensible diaphragm. The pressure chamber has air line communication with the pump, and is pressurized by the latter simultaneously with pressurization of the water bottle thereby. Water passage means from the bottle to a faucet situated at a convenient height above the floor is provided so that water can be drawn from the bottle through the faucet. The microswitch-pump circuit is normally closed to permit energization (and operation) of the pump. When pressure builds up to the critical level in the water bottle, it also builds up in the pressure chamber and causes the diaphragm to bulge outwardly into contact with the control button of the microswitch, its position relative to the control button being such as to make this possible. The microswitch is highly sensitive, and the slightest movement of the diaphragm against its control button causes the switch to open the circuit and shut off power to the pump. When this occurs, the pressure in the water bottle remains substantially constant because the system is sealed against air leakage. When water is drawn from the bottle through the faucet at the top of the water line, the air pressure within the bottle drops causing the pressure chamber diaphragm to shrink away from the control button of the microswitch. This results in rapid closure of the pump circuit and causes the pump to build up the pressure within the bottle to the critical level again, at which point the diaphragm of the pressure chamber once more opens the microswitch to shut down the pump.

The diaphragm of our novel pressure chamber responds to a very slight pressure drop in the water bottle, for example, such as occasioned by the removal of a glass of water from the bottle (causing a pressure drop of perhaps ½ psi or less), and this, coupled with the high sensitivity of the microswitch, results in close control of the pressure level within the water bottle, which, in turn, makes for a fairly constant flow of water from the dispenser, when it is turned on, regardless of the water level in the bottle. The field coil actuated pump is of the type employed for aquarium aerating purposes, and has no moving parts (such as belts, pistons, etc.) or points to wear out. It is therefore capable of long and trouble-free operation with little or no maintenance. Furthermore, its energy requirements are minimal (something like 4 watts, as will be seen), which means that the cost of opertion of the dispenser is extremely low and such operation involves very little drain on the available supply of electrical energy in these days of dwindling energy sources.

The dispenser of this invention has a three-sided, lightweight cabinet mounted on rollers and designed to fit around an upright water bottle on the floor. The design and arrangement of parts of the dispenser are such that it can be easily connected to a standing water bottle on the floor, after which the cabinet can be rolled over the bottle to substantially conceal it from view. No lifting of the heavy bottle of water is thus required so long as the bottle is in the proper place to start with, something that can be easily arranged by proper instructions to a water delivery man.

As will be clear, at least in part, from the foregoing, our novel water dispenser is of relatively simple and inexpensive construction, dependable in operation, long-lasting and relatively maintenance free and of attractive appearance.

It is thus a principal object of this invention to provide relatively inexpensive, dependable, long-lasting, substantially maintenance free and attractive means for use in the dispensing of high purity drinking water from an upright five-gallon water bottle on the floor.

It is another object of the invention to provide such means capable of dispensing the water on demand under optimum flow conditions and at a substantially constant flow rate.

It is still another object of the invention to provide such means which can be used without the necessity of lifting, or otherwise moving, heavy water bottles from upright floor positions.

Other objects, features and advantages of the invention will become apparent in the light of subsequent disclosures herein.

BRIEF DESCRIPTION OF THE DRAWINGS

FIG. 7 is an enlarged top plan view of said microswitch and a cooperating pressure chamber forming another part of the unit.

FIG. 8 is a side view of the microswitch and pressure chamber.

FIG. 9 is another view of the microswitch and pressure chamber, this view being similar to FIG. 8, but of partially fragmentary form and showing the pressure chamber in cross-section.

FIG. 10 is a further enlarged side view of the FIG. 8 pressure chamber along with a fragmentary portion of the microswitch to illustrate first contact between a control button on the microswitch and a diaphragm forming the top of the pressure chamber as a result of the outward bulging of the diaphragm under the influence of air pressure in the chamber.

FIG. 11 is a view similar to FIG. 10, but showing the control button pushed slightly inwardly from its normal position by the further distended diaphragm to open the microswitch.

FIG. 12 is a back view of the dispensing unit and water bottle in their FIG. 2 positions, parts of the upper portion of its cabinet being shown partially broken away for better illustrative effect.

FIG. 13 is an enlarged fragmentary sectional view of a rubber closure cap positioned on said bottle and means permitting the passage of air into, and water out of, the bottle, taken along line13—13 of FIG. 12.

DESCRIPTION OF THE PREFERRED EMBODIMENT

Figures 1, 2, 3, 4, 5, 6:
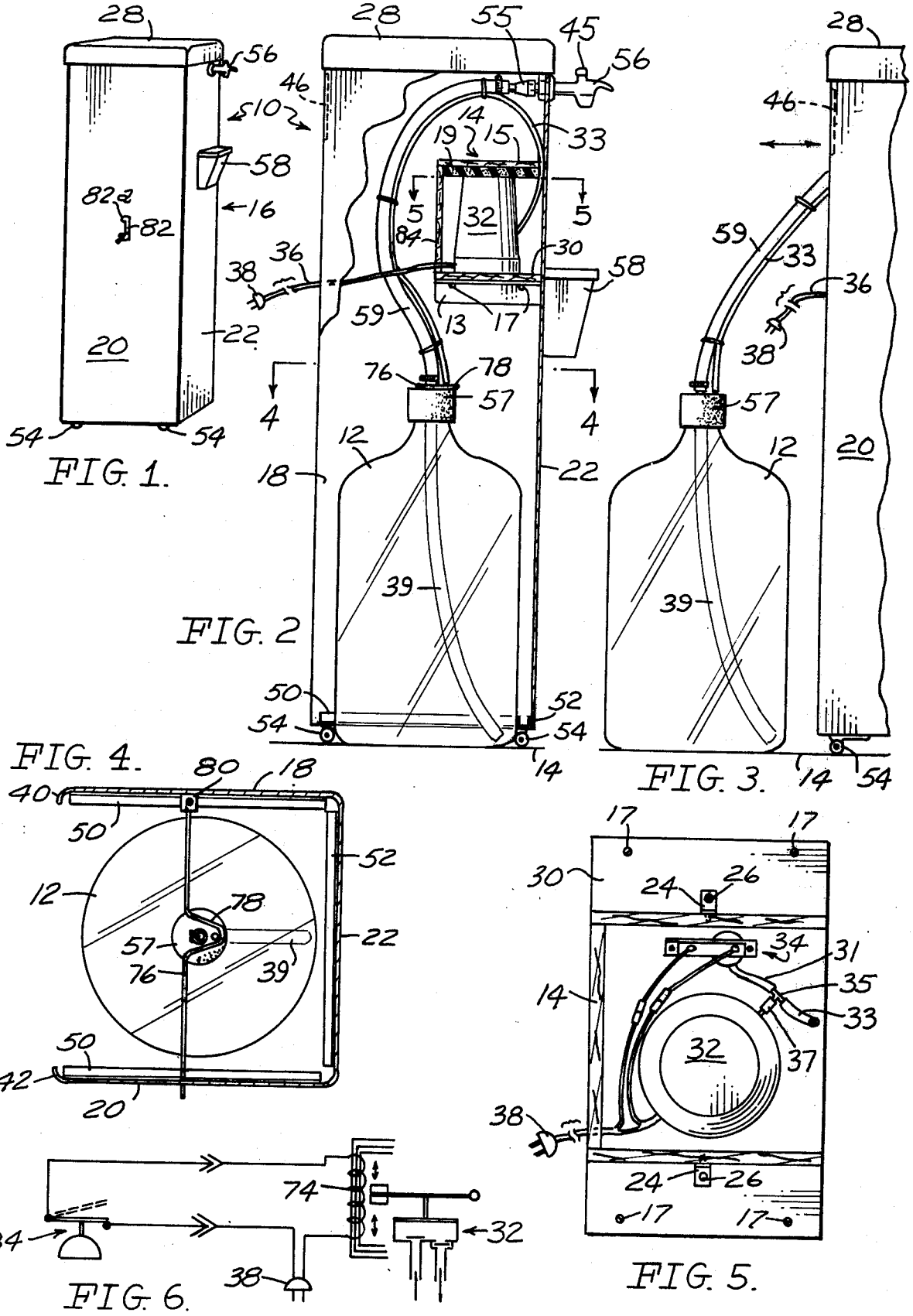
FIG. 1 is a perspective view of a water dispensing unit of preferred form in accordance with this invention.
FIG. 2 is an enlarged side view of the unit connected to a five-gallon water bottle for use, the unit being shown partly in section and the near side of a cabinet forming part of the unit being shown partially broken away.
FIG. 3 is a fragmentary view of the water dispensing unit connected to the water bottle, but rolled away from the latter to illustrate the manner in which it can be maneuvered to permit its easy coupling with the water bottle for use.
FIG. 4 is a slightly enlarged cross-sectional view of the unit, taken along line 4—4 of FIG. 2.
FIG. 5 is an enlarged sectional view of a housing supported by a shelf within the aforesaid cabinet, and showing important parts of the unit in top plan view, taken along line 5—5 of FIG. 2.
FIG. 6 is a circuit diagram illustrating the manner in which a microswitch forming part of the unit controls the operation of an air pump forming another part of said unit.

Considering now the drawings in greater detail, with emphasis first on FIGS. 1 through 5 and 12, there is shown generally at 10 a water dispensing unit of preferred form in accordance with this invention. Unit 10 includes a backless metal cabinet 16 adapted to fit fairly closely around a five-gallon water bottle 12 in the manner best illustrated in FIG. 4. The cabinet has a pair of vertical side walls 18 and 20, a vertical front wall 22, and a friction fitting top closure 28. Inside cabinet 16 is a wooden shelf 30 stretching horizontally, from side to side, thereacross and supported on a pair of angle iron brackets 11 and 13 spot welded to the side walls of the cabinet, which shelf is secured in position by machine screws 17 (see FIGS. 2 and 12). Preferably, but not necessarily, cabinet 16 is formed from 20 gauge sheet steel.

The shelf 30 supports an air pump and other functioning parts of dispensing unit 10, to be described below, which parts are enclosed by a three-sided wooden housing 14 that rests on the shelf 30, and is prevented from lateral movement by a pair of angled restraints 24 anchored to the shelf by means of threaded fasteners 26 (see FIGS. 5 and 12). Housing 14 abuts against the inner surface of front wall 22 of cabinet 16 so that its three side walls form, with the front wall 22, a surrounding enclosure for the air pump and other functioning parts, referred to above, of the water dispensing unit. The housing 14 has no bottom, because it rests on shelf 30 which forms a floor therefor, but it does have a top closure 15 internally lined with a layer of foam rubber 19. The air pump within the housing 14, shown at 32 in the drawings (FIGS. 2 and 5), is by far the largest of the parts within housing 14 and the top closure of the housing is high enough to clear the top of this pump with sufficient room to admit foam rubber layer 19 as a shock absorbing cushion between the pump and top closure. The pump operates from any 110-volt AC current source, and is provided with a conductor cord 36 fitted with a plug 38 that can be connected to any suitable electrical outlet. The conductor cord 36 passes outwardly through an appropriate opening in the rear wall of housing 14, shown at 84, in the manner indicated in FIGS. 2 and 12. While the conductor cord 36 is shown as an ordinary 2-wire cord, it will be appreciated that a 3-wire cord (with a 3-prong plug) can be substituted therefor if desired, or in jurisdictions where electrical codes require such wiring.

Along their back edges, the side walls 18 and 20 of cabinet 16 are bent to form confronting flanges 40 and 42. The flange 42 has a grommeted opening 44 in an enlarged portion through which the conductor cord 36 passes (see FIG. 12). Near the top of cabinet 16, at the back, is a flat stiffener member 46, preferably, but not necessarily, formed from 16-gauge steel, spot-welded to the inturned flanges 40 and 42, as shown at 48 in FIG. 12. Along the bottom edges of the cabinet side walls 18 and 20, two angle iron stiffeners 50 are spot-welded to those walls in confronting relationship, and at the bottom of front wall 22, a third angle iron stiffener 52 is spot-welded in position (see FIGS. 2, 4 and 12). These three angle iron stiffeners and the cross-piece stiffener 46 near the top of the cabinet serve to prevent twist distortion of the cabinet and give it the strength and durability to withstand accidental kicking of its walls and the various other abuses to which it might be subjected in use. Fastened underneath the inturned flanges of the side walls stiffeners 50 are four rollers 54. These rollers are preferably nylon ball bearing rollers of the type used on patio screen and glass doors, and they permit easy rolling of the cabinet 16 into and out of position around a water bottle for use and bottle changing purposes. Removably supported on a bracket, not shown, on the front wall of cabinet 16, beneath a faucet 56, soon to be described, is a drip basin 58 for said faucet.

The components of water dispensing unit 10 disposed within housing 14 include the aforesaid air pump 32 and a pressure switch assembly 34. Additionally, the unit includes a flexible water line 59, preferably formed of Tygon plastic tubing (which material has been approved bythe Food and Drug Administration as safe for use with drinking water), extending upwardly from a cap 57, to be described in greater detail below, on the bottle 12 to a point near the top of the inner side of front wall 22, where it is connected, through a fitting 55, to the faucet 56 (see FIG. 2). The faucet 56 is a standard-off-the-shelf item of the type having a valve with a push control knob 45 that opens when thumb pressure is applied to the knob. The water line 59 has no sharp turns so that there is minimal resistance to the flow of water therethrough. At its lower end, the water line is clamped onto the upper end of a metal tube 43, preferably of chrome-plated copper with a half-inch bore, that passes through an opening in the cap 57 in the manner illustrated in FIG. 13. Clamped to the lower end of the metal tube 43, beneath cap 57, by means of a clamp 41, is a section of flexible Tygon tubing 39 similar to that from which water line 59 is formed and of suitable length to reach to the bottom of bottle 12 (see FIGS. 2 and 3). Wall 22 of cabinet 16 has a slot 86 in its upper center portion (see FIG. 12) sized to receive the faucet 56 in the illustrated manner. This slot is not a critically necessary feature of the cabinet, however, and its primary purpose is to permit easy removal of the faucet from the unit for unit packaging purposes.

A short air line 37 connects the air pump 32 with a tee 35, a second air line 33 leads from the tee to a metal tube 29 (preferably, but not necessarily, a brass tube of 3/16th-inch bore)penetrating the bottle cap 57, and a third air line 31 extends from the tee to a pressure chamber 62 forming part of the pressure switch assembly 34. The metal tube 29 extends above cap 57 and the lower end of air line 33 is a friction-fitted thereon in the manner illustrated in FIG. 13. The air pump 32 is a low pressure diaphragm pump of the type commonly used in home aquariums for aerating purposes in which the diaphragm movement is actuated by an AC field coil. As previously indicated, such a pump requires very little power for operation, and, we have found, is capable of maintaining a pressure of 3–3.5 psig in the water bottle without any risk of creating dangerous pressure conditions in the bottle, even if let to run continuously. The pump does not run continuously in use, however, but only intermittently, as necessary to maintain a fairly constant pressure in the water bottle.

It is critically necessary, for proper functioning of our water dispensing unit, that the compressed air delivered to a water bottle by pump 32 be substantially free of particulate matter (dust, etc.) and other contaminating material (such as oil and the like).As those skilled in the art will appreciate, our air pump has no parts that function in frictional contact (such as pistons and cylinders), hence is not inherently contaminating by virtue of its manner of operation. Virtually all indoor air, except that in sterile environments, contains quite a bit of particulate matter such as dust and the like, which serves as an excellent carrier for bacteria. To keep such particulate matter and bacteria out of the water dispensed by our unit, we employ suitable filtering means in cooperation with out air pump. Air filtering means are well known, and we do not wish to be limited to any particular type of filter, or filtering system, since any filter, or system, capable of keeping the compressed air from our air pump substantially free of particulate matter will suffice for our purpose. Likewise, we do not wish to be limited to any particular air pump, so long as it is of a type capable of supplying low pressure air to a water bottle for purposes of this invention without contaminating the air with oil or other foreign matter. A pump which we have found to particularly suitable for use in our dispensing unit, however, is an aquarium aerator pump manufactured by Aquarium Air Pump Supply of Prescott, Arizona, sold under the name "Silent Giant, Model 120". This pump has built-in filters of four types (plastic foam, felt, gravel and cotton) that insure the removal of substantially all particulate matter in the incoming air before it reaches the drinking water in a bottle serviced by the unit. We have verified the effectiveness of the filters of the Silent Giant, Model 120 aerator pump in keeping particulate matter, and hence bacteria, out of bottled water pressurized by the pump by having a laboratory test conducted on a sample of water from a bottle that had been nearly exhausted by a water dispenser in accordance with this invention, which dispenser had, as of then, been in continuous use for six months. The test was a standard water potability test conducted by Clinical Laboratory of San Bernardino, Inc., a State-approved water testing facility. The water sample was placed in a sterile bottle in the laboratory, and tested for forty-eight hours for the presence of harmful bacteria. The results showed less than 2.2 coli mpn/100ml, meaning that the water was potable (free of harmful bacterial contamination). The air pump employed in the dispensing unit used to dispense water from the test bottle was a Silent Giant, Model 120, and the test results showed that, even after six months of service, this pump, with its built-in filters, delivered air substantially free of particulate matter and the bacteria accompanying same to that (test) bottle.

Preferably, the height of faucet 56 above the floor is about three feet (in a prototype, for example, we made the height 37 inches), this being a convenient faucet position for easy use of the dispensing unit by most persons, including children. It is, of course, necessary to maintain enough air pressure in bottle 12 to raise the water to this three-foot height, but excess pressure must be avoided because it would create a danger of bottle breakage in the case of glass bottles (for many years drinking water has been sold in glass bottles, although plastic bottles are now also employed for the purpose). We have discovered that about 3, to 3½ psig of air pressure provides an excellent flow rate from our unit, and is low enough to pose no threat of bottle breakage. Our discovery of the fact that a pressure this low is suitable for our purpose, and location of an inexpensive, trouble free, long lasting pump to maintain that pressure, were important factors that helped lead us to our unique water dispenser design.

Since it is necessary to operate our water dispensing system under low bottle pressures, a pressure control system of high sensitivity is required. To satisfy this requirement, we have designed a highly sensitive pressure switch assembly (34) capable of controlling operation of the pump so that it ceases to operate when the bottle pressure reaches a desired level (normally 3 to 3.5 psig), and starts up again when the pressure drops below that level. This sensitive pump control assembly is one of the critically important features of our water dispensing unit.

The details of the aforesaid assembly are shown in FIGS. 7–11. Basically, the assembly comprises the abovementioned pressure chamber 62 mounted beneath a microswitch 70 having a control button 72. The pressure chamber is a metallic cup-shaped member 63 having a cylindrical wall, preferably of one-inch diameter, enclosed at the top by a rubber diaphragm 66, preferably of 1/16-inch thickness. The diaphragm is sized to fit congruently on the rim of the cup-shaped member, and is held tightly thereagainst to seal the pressure chamber against leakage by means of a ring retainer 61 press-fitted onto said member. Affixed concentrically to the upper side of the diaphragm 66 is a metallic pressure plate 68. The under side of this plate is partially cemented to the diaphragm with a contact cement of the type used for cementing rubber to metal, but an annular area around the outer portion of the plate is left free of cement to facilitate bulging of the diaphragm under internal pressure in pressure chamber 62 in the manner illustrated in FIGS. 10 and 11. The cylindrical wall of the pressure chamber has a round opening 64 through which it is in communication with the air line 31 from tee 35.

Pressure chamber 62 is positioned under the control button 72 of microswitch 70 so that the button is situated directly over the center of diaphragm 66. The microswitch is of a type that is normally on, and its button is extremely sensitive, being capable of opening the switch when depressed only a slight amount (perhaps no more than 0.002 to 0.005 inch). It is wired in circuit with the AC field coil powering the pump 32, as illustrated in FIGS. 5 and 6, the field coil being schematically shown at 74 on the latter figure.

It is a simple matter to connect water dispensing unit 10 to a bottle of water for use. This can be accomplished by rolling the unit close enough to the bottle to permit cap 57 to easily reach it, then inserting the lower end of the flexible water tube 39 into the open neck of the bottle and threading the tube through the neck until the cap reaches the bottle, then forcing the cap into sealing position thereon. See FIG. 3, which shows typical positions of the bottle and dispensing unit after this has been done. It is now only necessary to roll the dispensing unit cabinet over the bottle to the position illustrated in FIG. 2, and the unit is ready for operation when conductor cord 36 is plugged into a suitable AC outlet.

FIG. 13 illustrates the manner in which cap 57 fits onto the neck of water bottle 12. As there shown, the cap has a cup-shaped hollow with a tapering wall 75 causing the hollow to converge inwardly so that the further the cap is pushed onto a bottle neck, the tighter will be the seal between the cap and neck. This permits use of the cap on the neck of any five-gallon water bottle, glass or plastic, presently employed for the sale of drinking water, at least insofar as we are aware. These bottles vary in neck design, and internal diameters of their neck openings, but all have the same maximum outside diameter so that one cap size will fit any of them. This is true even though the necks of the bottles differ externally in shape, in which connection, some are known to be threaded around counter-recessed portions, some to have the shape illustrated in FIG. 13, etc.

When the flexible water tube 39 is lowered into bottle 12 as far as it ca go, it reaches to a point near the deepest part of the bottle, this being a point near the outer periphery of its bottom, since the bottom has the convex shape (not shown in the drawings) common to five-gallon water bottles. This convex shape works to our advantage, because it permits the flexible tube 39 to reach low enough to remove almost all of the water from the bottle. When the bottle is substantially exhausted of water, dispensing unit 10 can be rolled away from the bottle again to about the distance illustrated in FIG. 3 and disconnected therefrom, then connected to a full bottle in the above-described manner. As will be apparent, once the full water bottle is positioned in a proper place for use by a delivery man, there is no necessity for the consumer to lift or move it in order to dispense its contents with dispensing unit 10.

To insure against the possibility of air pressure within bottle 12 forcing cap 57 off of the bottle, water dispensing unit 10 is provided with flexible retaining means 76 comprising a length of relatively thick spring steel wire, such as piano wire, mounted to swivel at one end in a U-shaped bracket 80 secured to the inner surface of side wall 18 of cabinet 16 by suitable fastening means, all as illustrated in FIGS. 4 and 12. Retaining means 76 is long enough to extend through a locking slot 82 in the side wall 20 of cabinet 16 (see FIG. 1) so that it can be shifted back and forth between a locked position on cap 57, in which its outer end is in a lower arm of the slot 82, as illustrated in FIG. 1, and an unlocked position, in which its outer end is in an upper arm **82*a* of the slot. At its midportion, wire retaining means 76 is curved to form a loop 78 that fits around the water and air lines passing through the cap into the bottle and rests on the cap when the retaining means is moved to its locked position in slot 82 (see FIG. 4**).

When water dispensing unit 10 is connected to a water bottle for use, wire retaining means 76 is adjusted to its locked position, and conductor cord 36 is plugged into a suitable AC outlet, electric current energizes air pump 32 and the pump delivers compressed air to the bottle through air line 37, tee 35, air line 33, and the metal tube 29 through cap 57. At the same time, the compressed air is delivered to pressure chamber 62, from tee 35, through the air line 31. As the air pressure builds up in the system, it causes diaphragm 66 on the pressure chamber to bulge outwardly, in the manner indicated in FIG. 10. The pressure chamber is so designed that as the air pressure in the bottle approaches a desired maximum (for example, about 3.5 psig), the pressure plate 68 on diaphragm 66 touches the control button 72 of microswitch 70. See FIG. 10, which shows the pressure plate as it first touches this control button. Continuing operation of the air pump raises the air pressure enough to cause further upward movement of the pressure plate, which then depresses the control button of microswitch 70 and opens that switch to shut off the power to the pump. Microswitch 70 is, as previously indicated, extremely sensitive, so that the slightest movement of the control button is sufficient to open the switch. FIGS. 10 and 11 graphically illustrated the high sensitivity of the microswitch by showing at 84 the degree of extension of control button 72 at first contact of the pressure plate 68 therewith, and at 86 the extension of the control button after it has been pushed by said pressure plate far enough to open the switch. The difference between extensions 84 and 86, of course, equals the travel distance of the switch button, although the magnitude of this difference is greatly exaggerated in the drawing for better illustrative effect.

When air pump 32 is turned off by the action of diaphragm 66 on microswitch 70, the air pressure in bottle 12 remains substantially constant until someone draws water from the bottle through faucet 56. This air pressure is sufficient to provide a gushing flow of water through the faucet when it is opened by pressure on its push control knob 45, in which connection we have determined that a quart bottle can be filled in about five seconds with our dispensing unit. By way of comparison, we have found that the prior art gravity flow system for obtaining water from a five-gallon bottle typically requires about seventeen seconds to fill a quart-sized container.

If water is drawn from bottle 12, the air pressure inside the bottle drops, and diaphragm 66 flattens to pull the pressure plate 68 down and away from the microswitch button 72. When this occurs, the microswitch closes, to energize the air pump, which resumes operation and again builds up pressure in the bottle to a point at which the diaphragm on pressure chamber 62 bulges to a sufficient extent to open the switch and once more shut down the pump. In this manner a fairly constant air pressure is maintained within bottle 12 as the water is dispensed therefrom, with the air pump coming on, as necessary, to build up the pressure when the withdrawal of water causes it to drop. Virtually all of the water in the bottle can, as previously indicated, be withdrawn by means of our water dispensing unit. To illustrate, we have discovered that all but about three teaspoonsful of the water in the bottle can be recovered by the use of our unit.

Any microswitch capable of performing as taught herein can, of course, be utilized in our water dispensing unit. Such microswitches are available from various sources, but one which we have found particularly suitable is manufactured by MICRO of Freeport, Illinois and commerically available as microswitch Type Z, No. BZ-2RO5.

As will now be apparent to those skilled in the art, the assembly of our water dispensing unit can be accomplished at relatively low cost from simple and inexpensive parts. Furthermove, the resulting unit is a dependable, relatively trouble free system that can be easily repaired when necessary at minimal expense. The unit is capable of dispensing water fast and efficiently with a minimum of waste, and is safe to use because of the low pressure under which it operates. Also, it comes equipped with an attractive cabinet, that can be finished in various ways to suit it for use in any home or office environment. Most importantly, our novel water dispensing unit can function for long periods without contaminating drinking water through the addition of foreign substances from the air or elsewhere, and it can be easily rolled into position over an upright water bottle on the floor for use. There is no necessity of even lifting the bottle a few inches to load the dispenser, as is required in the case of the patented (Terry) water cooler mentioned above. Finally, the air at floor level in a room is substantially cooler (perhaps as much as 5° F. cooler) than the air at the height of bottles in gravity flow dispensers, which means that water dispensed from our unit is cooler, and more refreshing, than that dispensed from a conventional gravity flow unit under most room temperature conditions.

While our novel water dispensing unit has been herein described and illustrated in what we consider to be its preferred embodiment, it will be appreciated by those skilled in the art that our invention in not limited to that particular embodiment,but is broad enough in scope to encompass all modifications thereof incorporative of the structural and functional essence of the invention as taught herein. Certain of these modifications have already been mentioned, and others will occur to those skilled in the art in the light of present teachings. For example, a dispensing unit cabinet of other than metal construction could be substituted for the metal cabinet 16 if desired. Where such a cabinet is employed, it should preferably be made from a material that is substantially noncorrosive in the presence of moisture and otherwise suitable for the purpose, examples of such materials being wood, fiberglass, various plastics other than fiberglass, etc.

Although we have herein stressed the applicability of the novel water dispensing means of this invention for use in drawing water from five-gallon water bottles, it should of course be understood that the unit might well have broader use potential than this, and can be employed in any capacity for which its unique character and capability suit it. For example, it might be employed for the dispensing of liquids other than water and the dispensing of any suitable liquid from other than five-gallon water bottles. Finally, it is emphasized that the scope of the present invention includes all variant forms thereof encompassed by the language of the following claims.

We claim:

1. Means particularly suitable for dispensing water from an upright bottle on the floor, comprising:

an pneumatic diaphragm pump actuated by an AC field coil for pressurizing said bottle to a pressure level above atmospheric pressure;

means associated with said pump for filtering air compressed thereby;

a normally closed microswitch having a sensitive control button adapted to open said switch when pressed inwardly;

a pressure chamber partially enclosed by a distensible diaphragm;

electrical wiring interconnecting said pump and said microswitch and adapted to receive electrical energy from a suitable source to power the pump when the microswitch is closed;

a gas line system for connecting the pump with said bottle and said pressure chamber to permit the pump to concurrently pressurize the bottle and pressure chamber to the same pressure level when said pump is operating;

means permitting the outflow of water from said bottle including a conduit arrangement of a length designed to extend from a point below the liquid surface in said bottle upwardly out of the bottle to a predetermined height, said conduit arrangement having a liquid dispensing head at its upper end adapted to remain normally closed but which can be readily opened to permit the outflow of water from said bottle under the influence of air pressure in the bottle;

the distensible diaphragm of said pressure chamber being adapted to bulge outwardly when subjected to air pressure within the chamber, and said pressure chamber being mounted in proximity to the control button of said microswitch so that the diaphragm bulges outwardly and exerts switch opening force on said button when the air pressure within the pressure chamber reaches the above-indicated pressure level of above atmospheric pressure;

whereby electrical energization of said pump after said first-mentioned means is connected to said bottle for use causes the pump to operate and pressurize said bottle and said pressure chamber to said pressure level above atmospheric pressure whereat the diaphragm on said pressure chamber exerts force on the control button of said microswitch to open said switch and inactivate the pump, and whereby the system is maintained at said pressure level above atmospheric pressure until water is withdrawn from the bottle through said liquid dispensing head to cause lowering of the pressure within the bottle and said pressure chamber, whereat said diaphragm immediately shrinks away from and ceases to exert forces on the control button of said microswitch and said pump is again energized to build up pressure within said bottle and pressure chamber until said diaphragm again bulges outwardly to exert switch opening force on said control button to cause cessation of operation of said pump; and whereby the means for filtering air compressed by the pump insures the substantial removal of particulate matter from the pressurized air entering the bottle when the pump is in operation to thereby substantially prevent the entry of bacteria on said particulate matter into said bottle and consequent pollution of the water by said bacteria so that drinking water in the bottle retains its purity for drinking purposes.

2. Means for dispensing liquid in accordance with claim 1 including a cabinet adapted to fit around said upright bottle, when that means is connected to said bottle for use, and to house other parts of the means for dispensing liquid in proper positional relationship for effective usage of the latter.

3. Means for dispensing liquid in accordance with claim 2 in which said cabinet is of lightweight character, attractive appearance and mounted to roll easily, and in which said conduit arrangement is such as to permit connection of the means for dispensing liquid to said bottle with the bottle standing outside of said cabinet, whereby said means for dispensing liquid can be connected to a suitable bottle for use and later disconnected therefrom by merely rolling said cabinet as necessary for the purpose and without any necessity of lifting said bottle.

4. Means for dispensing liquid in accordance with claim 3 adapted to sensitively maintain said pressure level substantially constant at from about 3 to about 5 psig and to provide a strong, steady flow of water from said bottle when said liquid dispensing head is opened.

5. Means for dispensing liquid in accordance with claim 4 in which said pressure level is from about 3 to about 3.5 psig.

6. Means for dispensing liquid in accordance with claim 4 in which said bottle has a relatively narrow neck, said means for dispensing liquid includes a resilient cap with a cup-like hollow adapted to snugly receive the open end of said neck in friction fit relationship so as to seal said neck, said cap being provided with openings through which said liquid conduit arrangement and a tubular branch of said gas line system pass in sealing relationship to communicate with the interior of said bottle, and in which the connection of the means for dispensing liquid to said bottle for use includes the step of forcing said cap onto said neck to seal the bottle against air leakage at the cap location.

7. Means for dispensing liquid in accordance with claim 6 in which the cup-like hollow in said cap has an inner wall of round cross-section that converges slightly from its open end so that further the cap is pushed onto the neck, the tighter will be its fit.

8. Means for dispensing liquid in accordance with claim 7 in which said cap is adapted to fit different size necks.

9. Means for dispensing liquid in accordance with claim 6 including a releasable retaining means for holding said cap in position on said neck during usage thereof.

10. Means for dispensing liquid in accordance with claim 9 in which the releasable retaining means comprises a length of resilient wire shaped to fit onto the top of said cap around said openings therein, means for pivotally supporting the wire at one end inside said cabinet, means permitting shifting of the other end of the wire between positions for cap holding and cap release purposes, respectively, from outside of said cabinet and means for restraining said other end in its position for cap holding purposes when that end is shifted into said position until such time as it is shifted out of that position.

* * * * *